US005606866A

United States Patent [19]

Anthony et al.

[11] Patent Number: 5,606,866

[45] Date of Patent: Mar. 4, 1997

[54] HEAT EXCHANGE UNIT FOR SELF-COOLING BEVERAGE CONTAINERS

[75] Inventors: Michael Anthony, Coral Springs; William D. Joslin, Jr., Boynton Beach, both of Fla.

[73] Assignee: The Joseph Company, Laguna, Calif.

[21] Appl. No.: 448,732

[22] Filed: May 24, 1995

[30] Foreign Application Priority Data

Nov. 8, 1994 [GB] United Kingdom ..... 9422479

[51] Int. Cl.[6] ..... F25D 3/10; F25B 9/02

[52] U.S. Cl. ..... 62/294; 62/5; 62/371

[58] Field of Search ..... 62/5, 293, 294, 62/371, 457.4

[56] References Cited

U.S. PATENT DOCUMENTS 3,525,236 8/1970 Solhkhah .
3,726,106 4/1973 Jaeger ..... 62/294
5,131,239 7/1992 Wilson ..... 62/293
5,331,817 7/1994 Anthony ..... 62/5
5,394,703 3/1995 Anthony ..... 62/5

*Primary Examiner*—William Doerrler
*Attorney, Agent, or Firm*—Robbins, Berliner & Carson, LLP

[57] ABSTRACT

A portable heat exchange unit for cooling a medium including a vessel adapted to contain a discrete quantity of a compressed or liquefied gas wherein the vessel includes a wall arranged to be placed in contact with the medium to be cooled, a valve for operatively controlling the release of the gas from the vessel, a panel positioned adjacent and inside the wall of the vessel for operatively directing the gas into heat exchange contact with the wall of the vessel and arranged to release gas from the top of the panel, and a means for exhausting the gas from the vessel. The panel has ridges thereon and engages the wall so as to form a plurality of channels between the ridges and the wall.

34 Claims, 6 Drawing Sheets

HEAT EXCHANGE UNIT FOR SELF-COOLING BEVERAGE CONTAINERS

This invention relates to a portable and disposable unit for cooling a beverage.

A wide variety of units have been proposed in the patent literature for cooling a beverage and, more particularly, for cooling a beverage contained in a disposable can. However, these devices have not been commercially successful. One reason they have not been successful is that they have not been compatible with conventional bottling methodology. In many instances, they require the use of specially designed beverage cans and, as a result, specially designed bottling or canning is required.

The present invention has arisen from our work in seeking to provide a heat exchange unit which can be inserted into a beverage can on the bottling line and which can be actuated by the pressure differential which occurs in the can when the can is opened. As will become clear from the detailed description below, we can produce embodiments of heat exchangers in accordance with the present invention in which the heat exchange unit can be used without modifying the construction of the conventional beverage can. The conventional can lid and bottom can be used. Hence, the production of canned beverages having a self-chilling capability can be easily integrated with the production of conventional canned beverages without any disruption or modification to the bottling or canning line.

In accordance with a first aspect of the invention, we provide a portable heat exchange unit for cooling a medium comprising: a vessel adapted to contain a discrete quantity of a compressed or liquified gas, the vessel including a wall arranged to be placed in contact with the medium to be cooled; a valve for operatively controlling the release of said gas from the vessel; a panel positioned adjacent and inside the wall of the vessel for operatively directing the gas into heat exchange contact with the wall of the vessel and arranged to release gas from the top of the panel; and a means for exhausting the gas from the vessel.

In a second and alternative aspect of the invention, we provide a heat exchange unit for use in cooling a beverage in a pressurized can, wherein the pressure in the can decreases when the can is opened and the can includes a lid, the heat exchange unit comprising: a vessel adapted to contain a discrete quantity of a compressed or liquified gas; and a valve for operatively controlling release of gas from the vessel, the valve being operatively arranged to open and release gas from the vessel in response to the decrease in pressure which accompanies opening the can.

The invention provides, in a third alternative aspect thereof, a container for a food or beverage comprising: a first vessel adapted to contain food or beverage; and a heat exchange unit including a second vessel containing a discrete quantity of a compressed or liquified gas, the second vessel including a wall in heat conducting contact with the wall of the first vessel or with its interior, said heat exchange unit including a valve for controlling release of the gas from the second vessel, a panel positioned adjacent and inside the wall of the second vessel for directing the gas into heat exchange contact with the wall of the second vessel and for releasing the gas from the top of the panel, and a means for exhausting gas from the second vessel.

According to a fourth alternative aspect, the invention provides a pressurized container for a food or beverage comprising: a first vessel adapted to contain the food or beverage, the first vessel including a lid having a tear panel for opening the container; and a heat exchange unit including a second vessel containing a discrete quantity of a compressed or liquified gas, the second vessel including a wall in heat conducting contact with the wall of the first, a valve for controlling the release of the gas from the second vessel; wherein the pressure in the container decreases when the container is opened by means of the tear panel, the valve being adapted to open and to release gas from the second vessel in response to the decrease in pressure which accompanies opening the container.

In a preferred embodiment, the heat exchange unit provides efficient heat transfer through the use of a ridged panel which is situated in the heat exchange unit so as to form channels between the panel and the wall of the unit which direct vaporized gas up the sides of the heat exchange unit canister.

Preferably, the heat exchange unit floats to the top of the can during the can filling procedure.

In one embodiment, the gas cools the unit by flowing through channels formed by a panel member, which adjoins the inside wall of a first chamber in the unit and evaporating. The liquified gas travels up the channels by the physical action of the boiling gas. As the gas rises up the channels, it absorbs heat from the beverage through the wall of the first chamber. By selecting a material for the panel which is wettable by a liquified gas, extremely efficient heat transfer occurs from the medium being cooled to the gas. Once the gas has been warmed by the heat transfer, it is exhausted from the container.

In another embodiment, before being exhausted from the unit, the vaporized gas flows to a vortex generating device which creates a vortex field which generates a stream of cooled gas by the vortex effect. This stream cools the container in a second chamber of the unit. Thus, the container is cooled first by the evaporation of liquified gas and then by the gas after it passes through the vortex generating device.

In another embodiment, the heat exchange unit is preferably mechanically distinct from the container which it cools and is free-floating in the beverage. When the can is opened, a pressure differential in the can causes a valve to open and the gas to be released from the unit.

The invention is hereinafter more particularly described by way of example only with reference to the accompanying drawings, in which.

Figure 1:
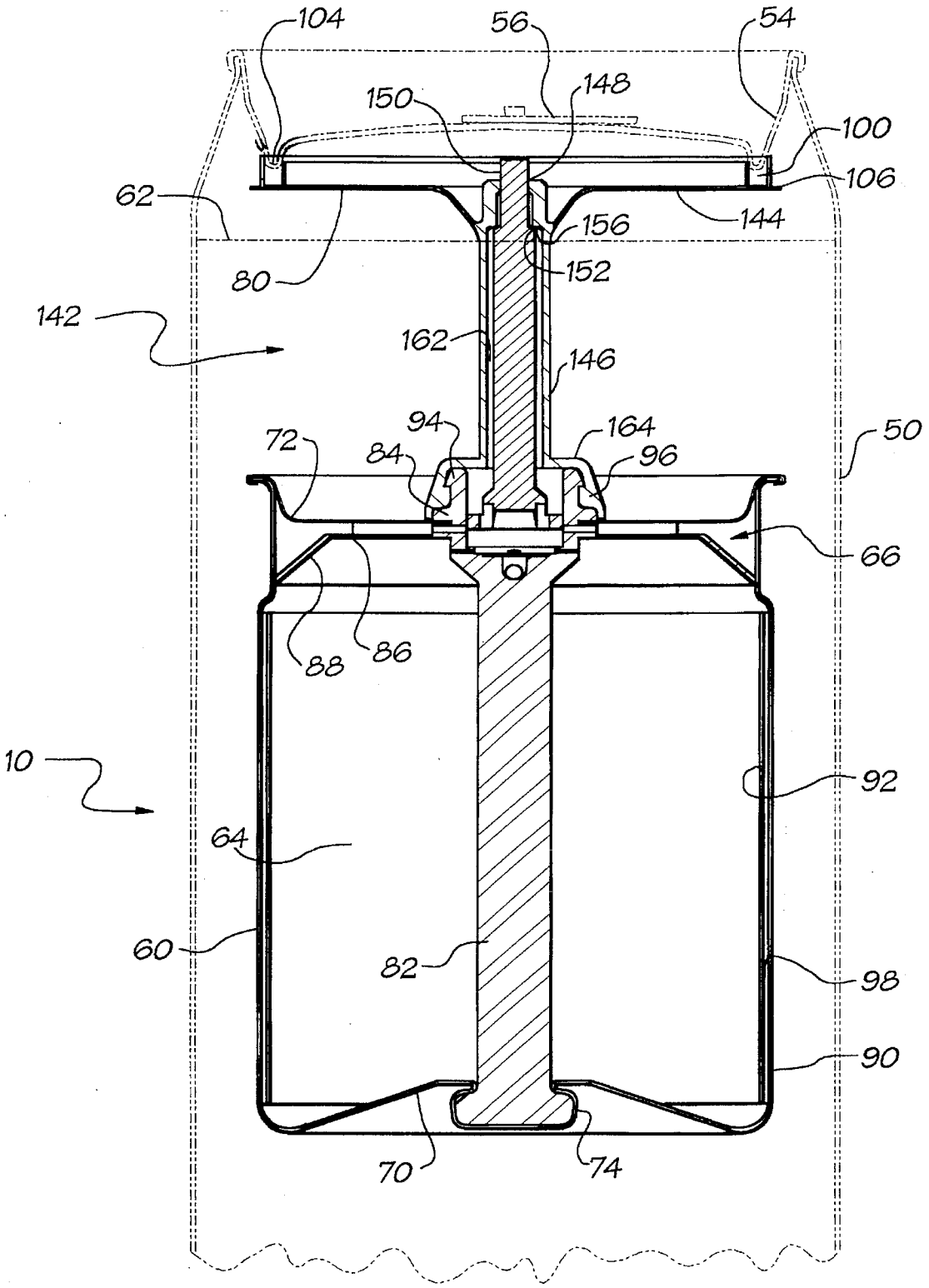
FIG. 1 is a cross-sectional illustration of a self-chilling beverage container in a deactivated condition.

FIG. 1 illustrates a beverage container of the type that may be used to contain beverages such as beer, soda, fruit juices and the like. The can 50 includes a lid 54 which includes a conventional pull top 56 capable of opening a hole for drinking in lid 54 in a conventional manner. The lid 54 conventionally includes an annular ridge 104 therein.

The beverage can 50 includes a heat exchange unit 10 which is immersed in the beverage 62 in the can 50. The heat exchange unit includes a canister subassembly 60 and an actuator subassembly 142 which snap together at flanges 94 and 96 as described herein. Canister 60 contains a gas (not shown) which is employed to cool the beverage 62 and is contained under pressure in a compressed or liquified state. In a preferred embodiment, the canister contains a liquid refrigerant under pressure. However, it is also possible to use a compressed gas such as carbon dioxide. Canister 60 includes a base 70, an integral lid 72 and a wall 90.

Figure 4A:
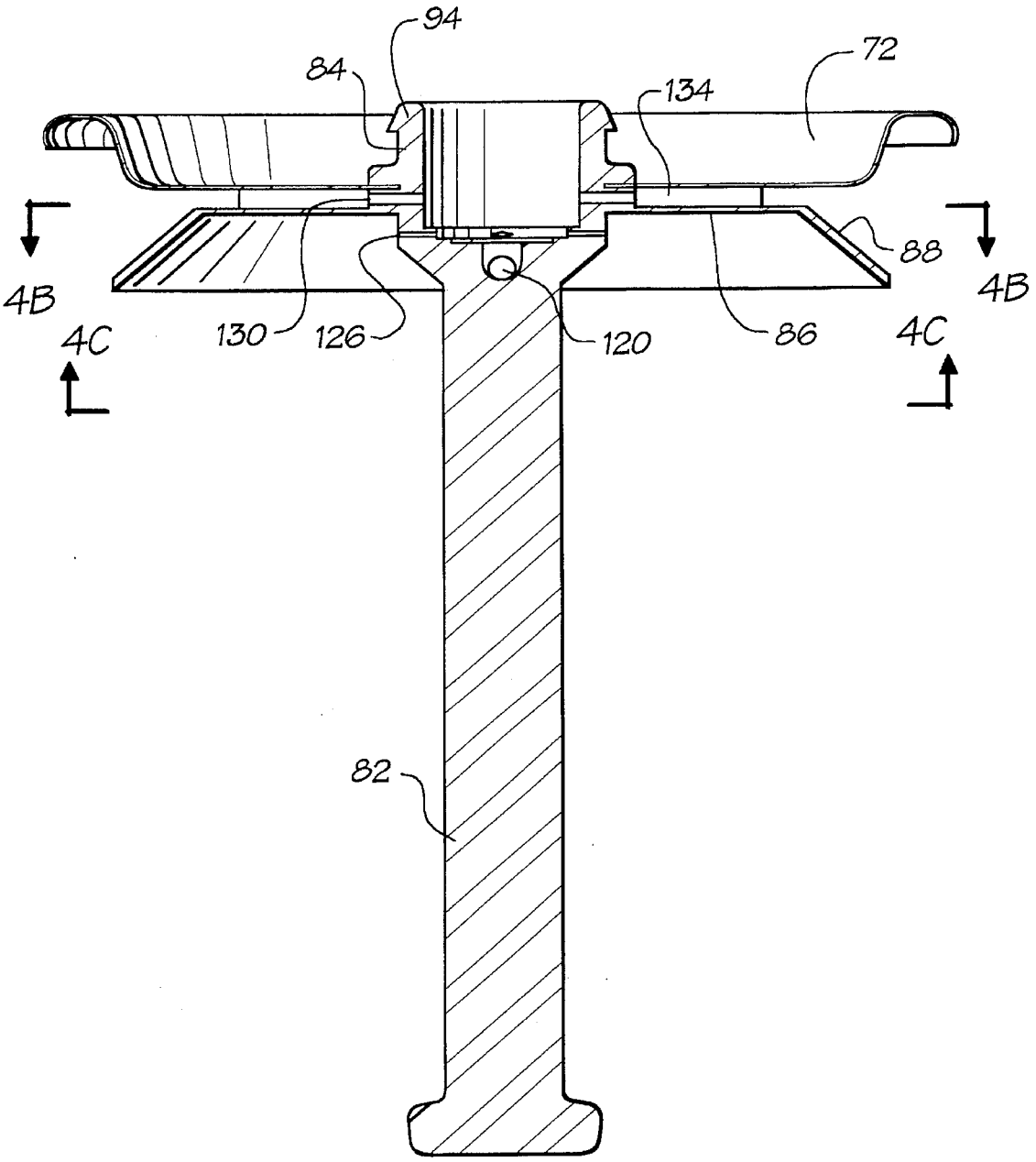
FIG. 4A is a cross-sectional view of the center post of the heat exchange unit.

As seen in FIG. 1, post 82 is captured in recess 74 in base 70 of canister 60 by means of a friction or snap fit or by being thermoplastic and heated such that when it is inserted into the recess 74 in the base, it conforms to the shape of recess 74. Post 82 reinforces the canister 60 when it is under pressure and prevents base 70 and lid 72 from being outwardly deformed by the pressure in the unit. Hub 84, which is hollow and cylindrical, extends upwardly from post 82. Around its outer surface, hub 84 includes a flange 94 for receiving flange 96 of annular rim 164 in a snap fit as explained later. Disc 86, which is shown in FIG. 4A, extends radially from hub 84 and includes an annular flanged portion 88. As shown in FIG. 4C, post 82 also includes a plurality apertures 120 which are connected by tubes 122 to apertures 74 in disc 86. A plurality (typically four) channels 126 are located at the base of hub 84 to provide proper coolant flow into the vortex generating area 78 to create a helical air flow, as discussed below.

Figure 4B:
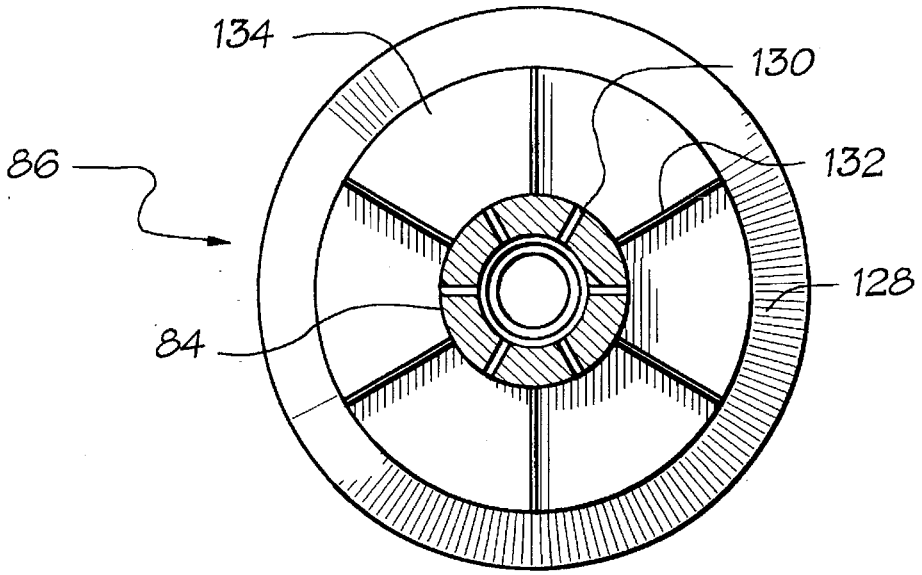
FIG. 4B is a view of the center post of the heat exchange unit along line 4B—4B.
Figure 4C:
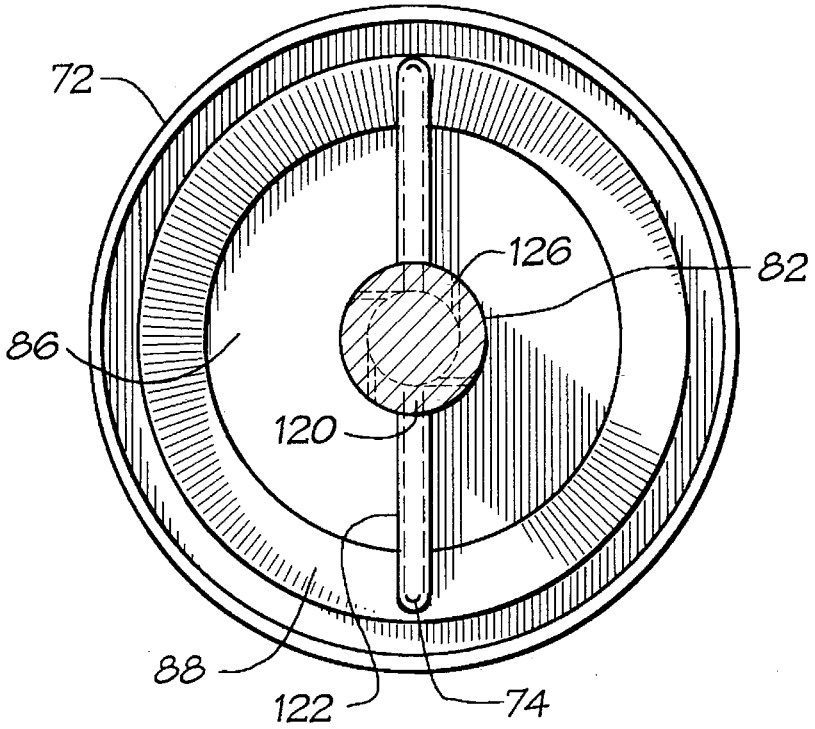
FIG. 4C is a view of the center post of the heat exchange unit along 4C—4C.

As shown in FIG. 4B, disc 86 has a plurality of ridges 132 on its upper surface. These ridges 132, when in contact with lid 72, form compartments 134 which provide for increased heat exchange contact between the gas and the beverage. A plurality of channels 130 in hub 84 provide a means of communication between areas 134 and passage 162.

Canister 60 of heat exchange unit 10 is divided into a first heat exchange chamber 64 and a second heat exchange chamber 66. Base 70, disc 86 and wall 90 form first heat exchange chamber 64. Chamber 64, along the inside of wall 90, includes panel 92 which preferably includes ridges 192 thereon. Ridges 192 form a plurality of channels 98 along the inside surface of wall 90. Lid 72, flanged portion 88 of disc 86, and wall 90 form second heat exchange chamber 66. This second heat exchange chamber 66 communicates with compartments 134 to provide a second section of the heat exchange unit 10 in which the gas can exchange heat with the medium to be cooled.

Figure 3A:
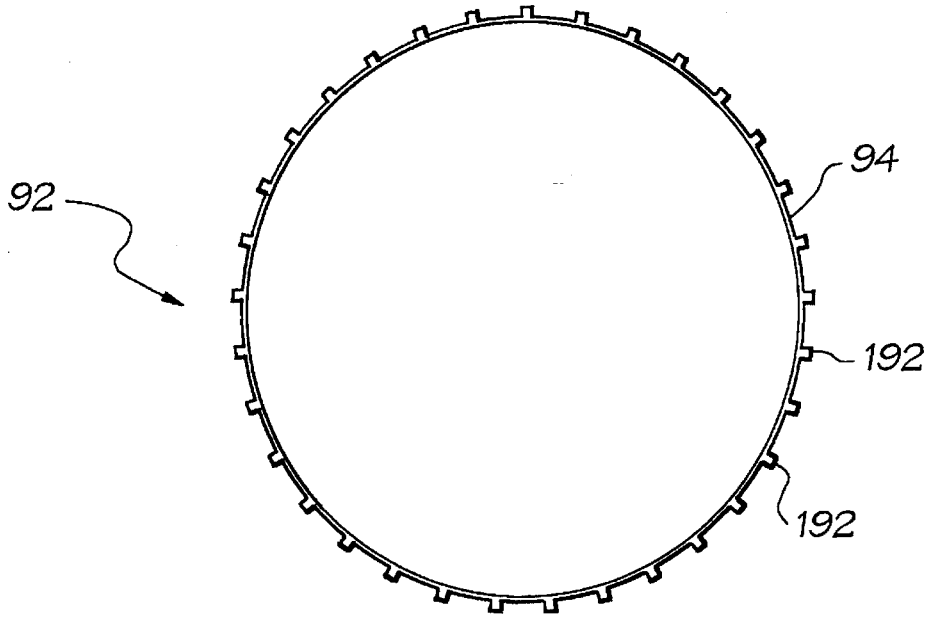
FIG. 3A is a top view of the panel which lines the inside of the heat exchange unit.
Figure 3B:
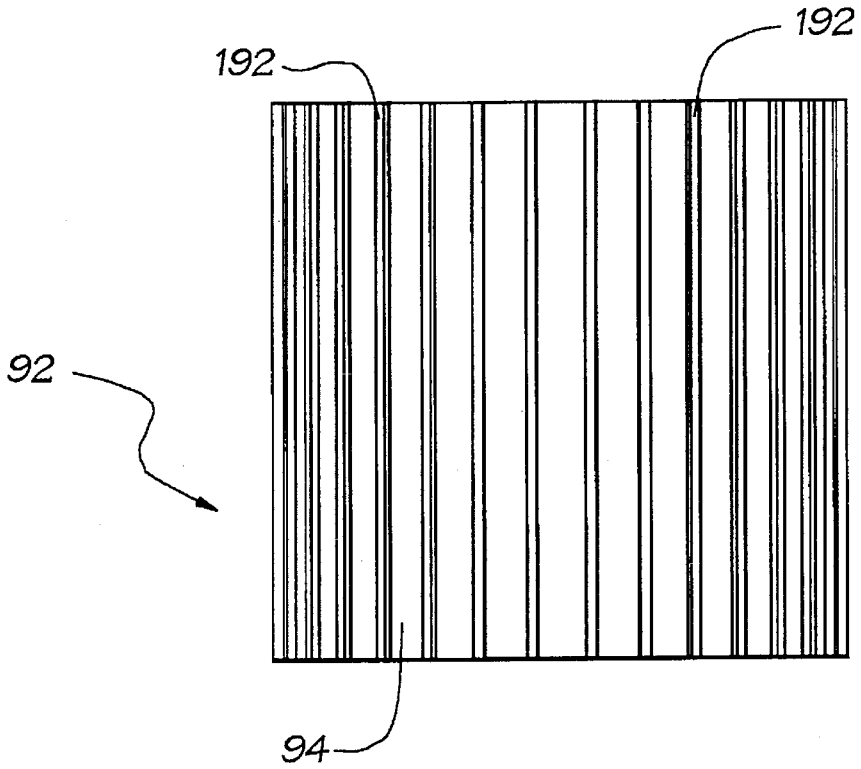
FIG. 3B is a side view of the panel which lines the inside of the heat exchange unit.

Panel 92, which surrounds the inside circumference of wall 90, can be formed from polypropylene, polyester, or polycarbonate, with polyester being preferred. In a preferred embodiment, panel 92 is formed of a material which is capable of being wetted by the liquified gas. As seen in FIGS. 3A and 3B, panel 92 includes a plurality of ridges 192 spaced along wall 94. These ridges 192 are spaced apart from each other by approximately 10° measured from the center of one ridge to the next and these ridges, along with walls 90 and 94, form a plurality of channels 98. Each ridge extends from wall 94 approximately 0.02 inch (0.51 mm) and is approximately 0.02 inch (0.51 mm) in width. Typically, panel 92 is approximately 2.23 inches (56.6 mm) in height and has a length sufficient to engage the entire inside circumference of canister 60. One skilled in the art will appreciate that the dimensions of ridges 192 and channels 98 will vary depending on the size of the heat exchange unit in which the panel 92 is used. Dimensions will vary in the size of the can the unit is designed to cool. Although channels 98 are illustrated as running perpendicular to base 70 of chamber 64, one skilled in the art will appreciate that channels 98 could spiral or take any path which would provide for effective cooling of beverage 62 in can 50.

Figure 2:
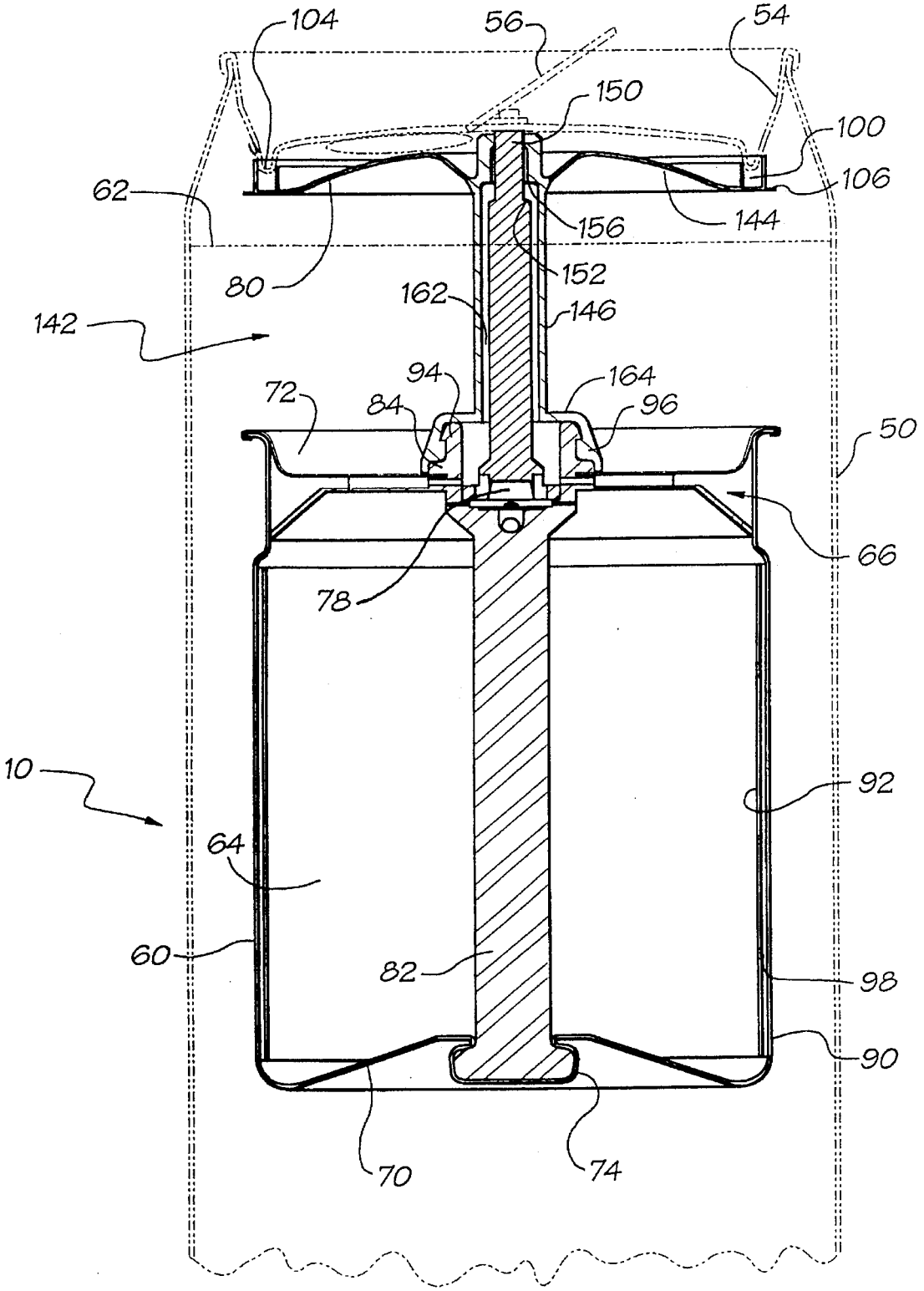
FIG. 2 is a cross-sectional illustration of the beverage container in an activated condition.
Figure 5:
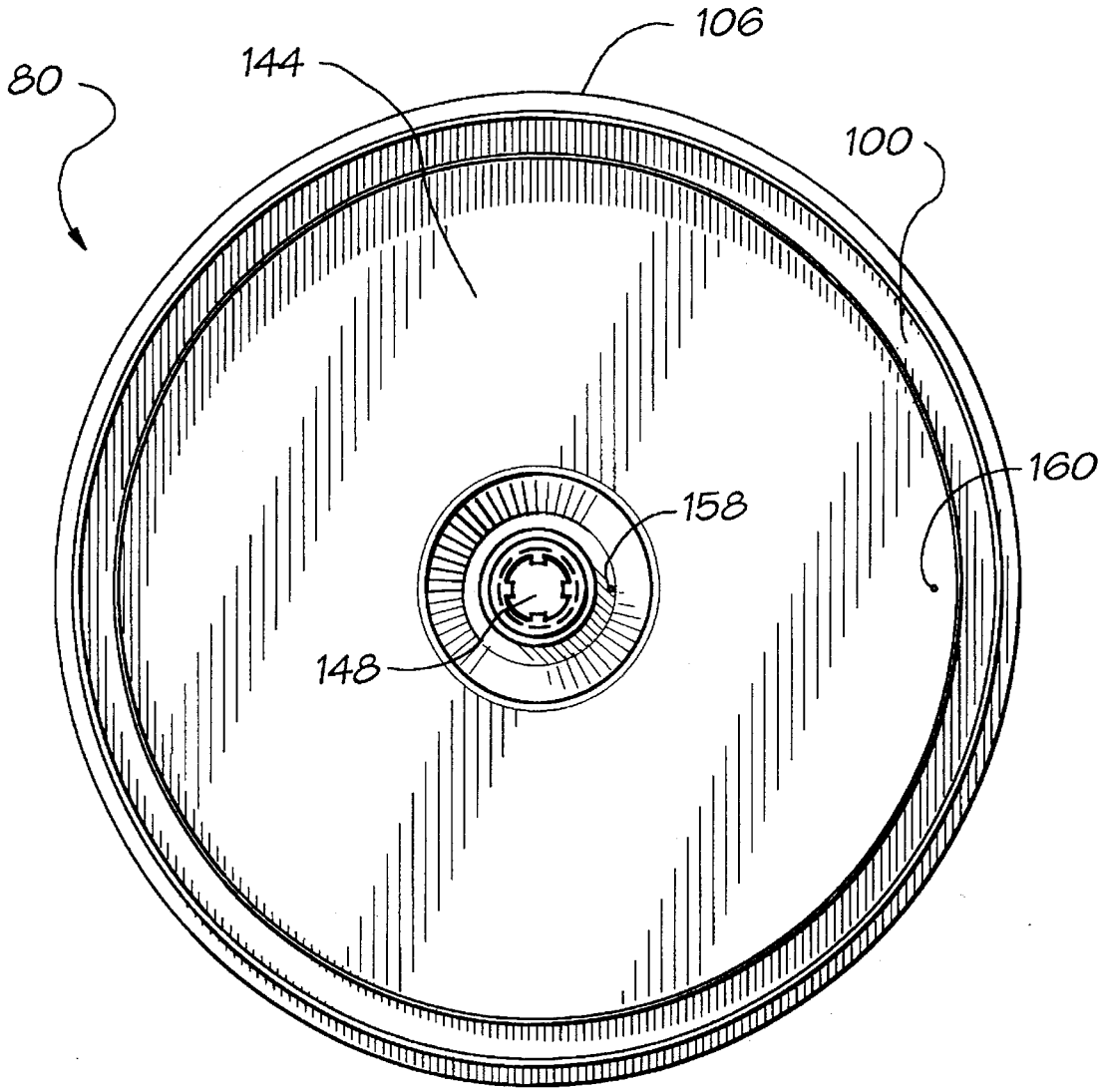
FIG. 5 is a top view of the exhaust port of this invention.

As shown in FIGS. 1 and 2, actuator subassembly 142 includes annular panel 80, groove 100, panel 144, an integral tubular base 146 and actuator 150. Tubular base 146 expands radially into an annular rim 164 having a flange 96 for capturing the flange 94 in a snap fit. Base 146 includes a channel 162 which runs the length of base 146. Actuator 150 extends through base 146 and extends from subassembly 142 through aperture 148 in annular panel 80. Aperture 148 may be hexagonal and actuator 150 may be circular in cross-section to provide access for ventilation of the unit 10, as described below. Annular panel 80 and membrane 144 are circular and annular panel 80 includes groove 100 around its outer periphery. Flange 106 extends from the outside of groove 100. Actuator 150 includes a shoulder 152 which engages a shoulder 156 in base 146 to seal channel 162 when the unit is in an inactive condition. As seen in FIG. 5, annular panel 80 also includes aperture 158 and aperture 160.

To provide for a floating unit, the unit 10 may be formed of any plastics used to blow mould or injection mould parts. Plastics such as polycarbonate, polyethylene, and polyester have been found to be useful and polyester has been found to be particularly useful. Canister 60 may be formed from aluminium or plastics. However, aluminium is preferred because of its superior heat transfer characteristics.

The heat exchange unit 10 is also designed so that it can be placed into a standard beverage can 50 during the canning process. After the unit 10 has been inserted into the beverage can 50, the beverage can 50 is filled with beverage 62. Once the can 50 has been filled with beverage 62, lid 54 is positioned on can 50 and seamed into position. In a typical canning process for carbonated and non-carbonated beverages, before can 50 is sealed, a shot of an inert gas such as nitrogen is injected into can 50 to pressurize can 50. The assembled heat exchange unit 10 is designed such that when can 50 is filled with beverage 62, the heat exchange unit 10 floats toward the top of can 50 and is prevented by flange 106 from protruding from can 50. In a sealed can, the pressure of beverage 62 slowly increases due to a release of nitrogen pressure and/or carbonation within the body of beverage 62. The unit 10, guided by the shape of can 50 and more particularly the frustoconical mouth portion of the can, floats upwardly and groove 100 on the unit engages ridge 104 on the can. Apertures 158 and 160 are provided in annular panel 80 to allow the nitrogen gas or carbonation to escape so that the unit is not activated as it attaches to lid 52 of can 50. Apertures 158 and 160 are dimensioned such that they will allow the pressure in can 50 to equilibrate during the filling process but do not allow the pressure in can 50 to equilibrate during the activation process.

Annular panel 80 encompasses the tab area of the can 50. The density of the unit 10 is approximately equal to that of the beverage 62 so that the unit 10 will not easily dislodge from lid 52 while can 50 is in a sealed condition. Annular panel 80 prevents the beverage 62 from flowing from the can 50 when the can 50 is An the sealed, inactive condition, unless the pressure of beverage 62 is reduced to atmospheric pressure causing annular panel 80 to release from lid 54, as described below. When the can 50 is opened and the seal is broken, annular panel 80 releases from the lid 54 of can 50 after the unit 10 has cooled the beverage 62, as described below, allowing beverage 62 to be poured from the can 50.

To activate the heat exchange unit 10, the can 50 is opened by means of pulltop 56 in lid 54. Upon opening the can 50, a pressure differential is created between the space above membrane 144, which attains atmospheric pressure, and the body of beverage 62. The pressure differential between beverage 62 and the atmospheric pressure in the space above membrane 144 forces the unit 10 toward lid 54 of the can 50 causing actuator 150 to be depressed when it contacts lid 54. This pressure differential results from the beverage having a pressure of approximately 20–30 p.s.i. (1.37895 to $2.068425\times10^5 N/m^2$ and atmospheric pressure being approximately 14 p.s.i. ($9.65265\times10^4 N/m^2$). As seen in FIG. 2, the upward motion of the unit 10 causes membrane 144 to flex upwardly. As stated above, apertures 158 and 160 are not large enough to allow the pressure above and below annular panel 80 to equilibrate and prevent activation of the heat exchange unit 10. Actuator 150 is pushed toward vortex area 78 by contact with lid 54 of can 50. As actuator 150 moves toward vortex area 78, passage 162 is opened as shoulder 152 of actuator 150 moves away from shoulder 156 in base 146 of annular panel 80. Once passage 162 is opened, the gas has a route to escape from the unit 10 and, thus, the unit 10 becomes activated.

Once the unit 10 has been activated, the pressure on the gas in canister 60 decreases which causes the gas to boil. This boiling action causes-the-liquified gas to flow into the bottom of channels 98. The first point of heat transfer between beverage 62 and the liquified gas occurs within the channels 98. Heat from the beverage 62 is absorbed by the gas through wall 90 of canister 60 as the gas vaporizes by means of adiabatic expansion. As the temperature of the gas increases, the liquified gas begins to boil within the channels 98. This boiling action propels the liquified gas upward into channels 98. Further exposure of the upward flowing gas to the heat exchange surface of chamber 64 causes the gas to boil off. This progressive boiling and propagation of the liquified gas insures that the entire interior surface of wall 90 and base 70 of canister 60 are bathed with cooling gas. This method considerably increases the heat exchange efficiency of unit 10.

After the gas has flowed up and through channels 98, it is exhausted from the unit 10. The gas flows from channels 98 into the space vacated by the liquified gas in chamber 64. The gas then flows into channels 126 and into vortex area 78. The gas exits vortex area 78 and flows through apertures 158 in the base of actuator 150 into channel 162. It is then exhausted from channel 162 through the slots in aperture 148. The gas then flows through lid 54 of the can 50 by means of the opening created by pull top 56.

The unit is optionally equipped with a vortex generator which functions as follows. In a preferred embodiment, once the gas exits channels 98 and before being exhausted from can 50, the gas flows into vortex generating area 78 through channels 126 in hub 84. As seen in FIG. 2, vortex generating area 78 is opened when actuator 150 is moved downwardly upon activation of the unit 10. In vortex generating area 78, a helical gas flow is created as the gas enters area 78 through channels 126 which are shown in FIG. 4A. The helical gas flow results from channels 126 which, in this embodiment, are arranged tangentially to area 78. Thus, as the gas enters area 78 a circular flow is provided. The function of a vortex generator is to generate a stream of cooled gas and is described in U.S. Pat. No. 5,331,817 to Anthony, the disclosure of which is to be regarded as hereby incorporated by reference. The helical gas flow rises through the center of vortex generating area 78. A back pressure is created as the spiraling gas contacts the bottom of actuator 150. Cooled gas is forced downward through an aperture (not shown) in the center of hub 84 to apertures 120. The warmed gas is then exhausted from can 50, as described below.

The vortex generating area 78 may include baffles (not shown) to enhance the vortex effect. The ability of the vortex generating area 78 to establish and sustain a high velocity helical gas flow may enhance the efficacy of the heat exchange unit 10. The exact dimensions of vortex generating area 78 will vary, particularly depending on the size of can 50 in which the unit 10 is used and in the amount of cooling required from unit 10.

The cooled gas flows from vortex generating area 78 to chamber 66 by means of apertures 120 at the base of hub 84. The gas flows from apertures 120 to chamber 66 by means of tubes 122. Once in chamber 66, the cooled gas absorbs heat from the beverage 62 through wall 90 and lid 72 of canister 60 and further cools beverage 62 as it flows toward hub 84 through areas 134. As the gas flows through chamber 66 toward hub 84, it becomes warmed by means of its heat exchange with the beverage. The warmed gas flows through channels 130 in hub 84 and into passage 162. The gas is then exhausted from the unit 10 between actuator 150 and aperture 148 as described above.

As the cooled gas moves to cool the beverage 62, the warmed gas is simultaneously exhausted from the unit 10. The warmed gas flows through passage 162 and exits the unit 10 and can 50 in the Same manner as described above.

Vortex generating area 78 and channels 126 are designed to provide back pressure on the coolant gas in chamber 64. Because of the sizes of both channels 126 and the vortex generating area 78, the gas can only exit chamber 64 at a reduced flow rate. This reduced flow rate causes the gas to increase in pressure which, in turn, provides a pressure on the liquified gas to maintain the gas in a liquified condition. Without this back pressure, the liquified gas in chamber 64 would quickly evaporate and exit chamber 64 without flowing through channels 98 thus rendering the first heat exchange chamber 64 inoperative. Hence, even if the vortex effect is not desired for cooling, the back pressure created in area 78 contributes to the function of the can.

After the cycle of evaporation and optional vortex heat exchange is completed, the pressure of beverage 62 will normalize to atmospheric pressure. As the pressure of beverage 62 decreases, the pressure differential between beverage 62 and the area above membrane 144 correspondingly decreases. Eventually, the pressure differential will no longer exceed the pressure required to maintain membrane 144 in a flexed position. The heat exchange unit 10 is then pushed away from lid 54 by the recoiling of membrane 144 of annular panel 80 to its original, flat condition. Once the heat exchange unit 10 has moved away from the lid 54 of the can 50, the beverage 62 can then be poured from the can 50 for consumption. Because the heat exchange unit 10 is constructed of a material which will float in the beverage 62 and the gas originally in the can is exhausted, the heat exchange unit 10 floats toward the bottom of the can 50 as the beverage is tilted into position for pouring beverage 62 from the can 50 or for consuming the beverage 62 directly from the can 50. Thus, the flow of beverage 62 from the can 50 is not obstructed by the unit 10 during pouring or drinking.

The preferred gas employed to cool beverage 62 consists of a mixture of HOC 125, which is pentafluoroetane, and HFC 152a, which is difluoroethane. The gases are mixed in a ratio of about 20:80–40:60 (HFC 125:HFC 152a) and preferably in a ratio of about 30:70. The gas is stored at a pressure of 100 p.s.i. ($6.89475\times10^5 N/m^2$) at 75° F. One skilled in the art will appreciate that the mixture of the gases will vary depending upon the degree of cooling that is desired and the amount of pressure required by the particular configuration of the beverage container and the acceptable flammability limits of the particular gases employed. Another mixture which can be used is a mixture of propane, butane and HFC 134a, which is tetrafluoroethane, in a ratio of 25:25:50 (propane:butane:HFC 134a). Although this mixture works almost as well as the HFC 125:HFC 152a mixture, it is not as preferred because propane and butane are flammable. Furthermore, HFC 134a is not as environmentally friendly as HFC 125 or HFC 152a.

Although the vortex generating area 78 is described herein as creating the vortex by means of channels 126 being arranged tangentially to the vortex generating area 78, one skilled in the art will realize that the vortex generating device may take many forms. For example, the generator may include a member in the vortex generating area 78 for directing the gas in a spiral flow within the area 78. The member may include a plurality arcuately shaped baffles which direct the gas from a tangent on the inside of the generator 78 to the center of the generator. The generator 78 may also be configured in the manner described in U.S. Pat. No. 5,331,817 to Anthony, previously incorporated by reference, and U.S. Pat. No. 5,394,703 to Anthony, herein incorporated by reference.

One skilled in the art will also appreciate that this invention is not limited for use with carbonated beverages and that it can also be used with uncarbonated beverages. As stated above, it is common practice to can uncarbonated beverages with nitrogen pressure. Nitrogen can be used to provide enough pressure to allow the unit 10 to form an effective seal with ridge 104 and to activate the unit 10. Thus, uncarbonated beverages can be canned under pressure in practice of this invention. Where a pressure differential activates the heat exchange unit 10, the beverage 62 must be packed under some degree of pressure from nitrogen or some other inert gas to function properly.

We claim:

1. A portable heat exchange unit for cooling a medium comprising: a vessel adapted to contain a discrete quantity of a compressed or liquified gas, the vessel including a wall arranged to be placed in contact with the medium to be cooled; a valve for operatively controlling the release of said gas from the vessel; a panel positioned adjacent and inside the wall of the vessel for operatively directing the gas into heat exchange contact with the wall of the vessel and arranged to release gas from the top of the panel; and a means for exhausting the gas from the vessel.

2. A heat exchange unit according to claim 1, wherein the panel has ridges thereon and engages the wall so as to form a plurality of channels between the ridges and the wall.

3. A heat exchange unit according to claim 1, wherein the unit further comprises a vortex generator in the vessel.

4. A heat exchange unit according to claim 3, wherein the unit further comprises means for directing the gas released from the top of the panel into the vortex generator.

5. A heat exchange unit according to claim 4, wherein the vortex generator includes a tube and channels for tangentially introducing a gas into the tube so as to produce a spiral gas flow which generates a stream of cooled gas.

6. A heat exchange unit according to claim 5, further including means for operatively conducting the stream of cooled gas into heat exchange contact with the vessel.

7. A heat exchange unit according to claim 6, wherein the vessel includes a lid and a disc adjacent the lid, the disc having ridges thereon forming gas-conducting compartments with the lid, the stream of cooled gas being operatively conducted to said compartments adjacent the lid.

8. A heat exchange unit according to claim 1, wherein the gas is a liquified gas and the panel is formed from a polymeric material which is wetted by the liquified gas.

9. A heat exchange unit for use in cooling a beverage in a pressurized can, wherein the pressure in the can decreases when the can is opened and the can includes a lid, the heat exchange unit comprising: a vessel adapted to contain a discrete quantity of a compressed or liquified gas; and a valve for operatively controlling release of gas from the vessel, the valve being operatively arranged to open and release gas from the vessel in response to the decrease in pressure which accompanies opening the can, wherein the lid of the can includes a tear panel for opening the can, the heat exchange unit being adapted to be mounted within the can and comprising an annular panel having a first side facing the lid, a second side facing away from the lid and a hub; the annular panel being arranged to engage the inside of the lid of the can when the can is filled with a beverage surrounding the tear panel and the valve including a stem which extends through the hub in the annular panel; and the arrangement is such that upon opening the can, the pressure on the first side of the annular panel is less than the pressure on the second side of the annular panel and the annular panel is drawn toward the lid and the stem of the valve contacts the lid moving the valve in the hub from a closed to an open position.

10. A heat exchange unit according to claim 9, wherein a space is provided between the hub and the valve stem through which gas is arranged to be exhausted from the vessel when the valve is open, the space being sealed by the valve when the valve is closed such that gas cannot be exhausted from the vessel.

11. A heat exchange unit according to claim 10, wherein the annular panel includes a circular recess adjacent to its perimeter adapted to seat therein a corresponding annular ridge of the lid when the can is filled with beverage.

12. A heat exchange unit according to claim 11, wherein the vessel includes a wall arranged for operative contact with the beverage, and a panel positioned adjacent and inside the wall of the vessel for operatively directing the gas into heat exchange contact with the wall of the vessel and releasing the gas from the top of the panel.

13. A heat exchange unit according to claim 11, wherein the heat exchange unit further includes a vortex generator in the vessel.

14. A container for a food or beverage comprising: a first vessel adapted to contain food or beverage; and a heat exchange unit including a second vessel containing a discrete quantity of a compressed or liquified gas, the second vessel including a wall in heat conducting contact with the wall of the first vessel or with its interior, said heat exchange unit including a valve for controlling release of the gas from the second vessel, a panel positioned adjacent and inside the wall of the second vessel for directing the gas into heat exchange contact with the wall of the second vessel and for releasing the gas from the top of the panel, and a means for exhausting gas from the second vessel.

15. A container according to claim 14, wherein the heat exchange unit further comprises a vortex generator in the second vessel.

16. A container according to claim 14, wherein the panel is ridged and engages the wall of the second vessel so as to form a plurality of channels therewith.

17. A container according to claim 15, wherein the vortex generator includes channels therein for tangentially introducing a gas into the generator to produce a spiral flow.

18. A container according to claim 15, wherein a stream of cooled gas is operatively emitted from the vortex generator and the heat exchange unit further includes a means for conducting the cooled gas into heat exchange contact with the second vessel.

19. A pressurized container for a food or beverage comprising: a first vessel adapted to contain the food or beverage, the first vessel including a lid having a tear panel for opening the container; and a heat exchange unit including a second vessel containing a discrete quantity of a compressed or liquefied gas, the second vessel including a wall in heat conducting contact with the wall of the first, a valve for controlling the release of the gas from the second vessel; wherein the pressure in the container decreases when the container is opened by means of the tear panel, the valve being adapted to open and to release gas from the second vessel in response to the decrease in pressure which accompanies opening the container, wherein the heat exchange unit comprises an annular panel having a first side facing the lid, a second side facing away from the lid and having a hub, the annular panel being arranged to engage the inside of the lid of the container when the container is filled with a food or beverage, and the valve including a stem which extends through the hub in the annular panel; and wherein, in operation, upon opening the container, the pressure on said first side is less than the pressure on said second side whereby the annular panel is drawn toward the lid and the stem of the valve contacts the lid moving the valve from a closed position to an open position.

20. A container according to claim 19, wherein the hub includes a space surrounding the stem of the valve through which gas is arranged to be exhausted from the second vessel when the valve is opened, the space being sealed by the valve when the valve is closed such that gas cannot be exhausted from the second vessel.

21. A container according to claim 19, wherein the compressed or liquified gas comprises HFC-125 and HFC-152A or propane, butane, and HFC-134A.

22. A container according to claim 20, wherein the compressed or liquified gas comprises HFC-125 and HFC-152A or propane, butane, and HFC-134A.

23. A filled beverage container comprising a quantity of a beverage pressurized within the first vessel of a container according to claim 19.

24. A filled beverage container comprising a quantity of a beverage pressurized within the first vessel of a container according to claim 19.

25. A filled beverage container comprising a quantity of a beverage pressurized within the first vessel of a container according to claim 20.

26. A filled beverage container comprising a quantity of a beverage pressurized within the first vessel of a container according to claim 21.

27. A filled beverage container comprising a quantity of a beverage pressurized within the first vessel of a container according to claim 22.

28. A heat exchange unit according to claim 2, wherein the unit further comprises a vortex generator in the vessel.

29. A heat exchange unit according to claim 2, wherein the gas is a liquified gas and the panel is formed from a polymeric material which is wetted by the liquified gas.

30. A heat exchange unit according to claim 3, wherein the gas is a liquified gas and the panel is formed from a polymeric material which is wetted by the liquified gas.

31. A heat exchange unit according to claim 4, wherein the gas is a liquified gas and the panel is formed from a polymeric material which is wetted by the liquified gas.

32. A heat exchange unit according to claim 5, wherein the gas is a liquified gas and the panel is formed from a polymeric material which is wetted by the liquified gas.

33. A heat exchange unit according to claim 6, wherein the gas is a liquified gas and the panel is formed from a polymeric material which is wetted by the liquified gas.

34. A heat exchange unit according to claim 7, wherein the gas is a liquified gas and the panel is formed from a polymeric material which is wetted by the liquified gas.

* * * * *